US007974156B2

(12) United States Patent
Papi et al.

(10) Patent No.: US 7,974,156 B2
(45) Date of Patent: Jul. 5, 2011

(54) MOVEMENT FOR TIMEPIECE WITH RETROGRADE DISPLAY

(75) Inventors: Alberto Papi, La Chaux-de-Fonds (CH); Nicolas Dehon, La Chaux-de-Fonds (CH)

(73) Assignee: Sowind S.A., La Chaux-de-Fonds (CH)

( * ) Notice: Subject to any disclaimer, the term of this patent is extended or adjusted under 35 U.S.C. 154(b) by 492 days.

(21) Appl. No.: 12/294,960

(22) PCT Filed: Mar. 29, 2007

(86) PCT No.: PCT/EP2007/053061

§ 371 (c)(1),
(2), (4) Date: Sep. 29, 2008

(87) PCT Pub. No.: WO2007/110451

PCT Pub. Date: Oct. 4, 2007

(65) Prior Publication Data

US 2010/0246341 A1 Sep. 30, 2010

(30) Foreign Application Priority Data

Mar. 29, 2006 (CH) ..... 0516/06

(51) Int. Cl.
*G04B 19/02* (2006.01)
*G04B 19/04* (2006.01)

(52) U.S. Cl. ..... 368/80; 368/220; 368/228

(58) Field of Classification Search ..... 368/101, 368/106, 80, 220, 223, 228
See application file for complete search history.

(56) References Cited

U.S. PATENT DOCUMENTS

| | | | | |
|---|---|---|---|---|
| 3,696,609 | A * | 10/1972 | Dubois | 368/220 |
| 5,043,955 | A * | 8/1991 | Dubois et al. | 368/228 |
| 5,943,299 | A * | 8/1999 | Genta | 368/28 |
| 6,327,226 | B1 * | 12/2001 | Russi | 368/228 |
| 2005/0162982 | A1 * | 7/2005 | Suzuki | 368/145 |
| 2006/0126436 | A1 * | 6/2006 | Watanabe et al. | 368/28 |
| 2008/0159082 | A1 * | 7/2008 | Hiraga et al. | 368/228 |

FOREIGN PATENT DOCUMENTS

| | | |
|---|---|---|
| CH | 691 833 A | 10/2001 |
| CH | 694 349 A5 | 11/2004 |
| FR | 743 618 A | 4/1933 |

* cited by examiner

*Primary Examiner* — Vit W Miska
(74) *Attorney, Agent, or Firm* — Young & Thompson

(57) ABSTRACT

A movement for a timepiece having a retrograde display member displaying at least one time division, includes a going train, elements for driving the display member including a wheel unit driven by the going train and carrying a first cam sharing the same axis of rotation. The movement also includes a rocker supporting a probe held against the edge of the first cam by deformable elastic elements undergoing a deformation of variable amplitude. This results in the application of a corresponding force on the rocker in proportion to the distance between the probe and the axis of rotation of the first cam. The movement also includes drive members to connect the rocker to a retrograde display member. A force-regulating device is interposed between the elastic elements and the rocker.

19 Claims, 5 Drawing Sheets

MOVEMENT FOR TIMEPIECE WITH RETROGRADE DISPLAY

TECHNICAL FIELD

The present invention concerns a display module for timepiece movement designed to drive a retrograde display member displaying at least one time division, comprising a frame supporting drive means designed to drive the display member comprising a wheel, designed to be driven by a going train of the timepiece movement, and supporting a first cam sharing the same axis of rotation in reference to the frame. The display module also comprises a lever supporting a feeler-spindle arranged so as to bear against the periphery of the first cam under the effect of deformable elastic means undergoing a deformation of variable amplitude. This drives the application of a corresponding force on the lever, according to the distance separating the feeler-spindle from the axis of rotation of the first cam. The display module also comprises transmission means designed to connect the lever to the drive means of the retrograde display member.

The present invention also concerns a timepiece movement having the above characteristics as well as a timepiece comprising a movement of this type.

In the continuation of the text, the term "display module" designates the organs making it possible to drive an indicator organ, whether they are integrated directly on the plate of a clockwork movement or are effectively assembled in the form of a module likely to be attached to a preexisting basic movement. As a result, the term "frame" will designate the clockwork movement or an attached module bridge, without impact on the scope of the present invention, which is not limited to one or the other alternative.

BACKGROUND OF THE INVENTION

Many movements meeting the preceding definition are known in the prior art. As an example, patent CH 694 349, issued in the name of Franck Müller Watchland SA, describes of movement of this type designed to display both the minutes and hours in a retrograde manner. Each of the corresponding mechanisms comprises a lever with two arms connected by a bend, in the region of which the lever pivots in relation to the frame of the movement. The free end of a first arm supports a feeler-spindle arranged bearing against the periphery of a cam driven in rotation by the going train of the movement, while the free end of the second arm supports a rack arranged engaged with a going train of a display member. A long spring is connected to the frame by a first of its ends, while its second end is arranged so as to apply a force on the lever, to maintain the feeler-spindle in contact with the cam.

This type of construction presents certain drawbacks, in particular related to the application, to the going train of the movement, of a frictional force having a significant variation in amplitude between two extreme positions of the lever. Indeed, one sees, on one hand, that the axis of rotation of the lever is relatively remote from the feeler-spindle and, on the other hand, that the point of support of the spring on the lever is provided at the level of the feeler-spindle and is therefore also distanced from the axis of rotation of the lever. This results in a significant amplitude of the deformations of the spring between one and the other of the extreme positions of the lever, or a significant amplitude of the variation of the force this spring applies on the lever. The lever being arranged bearing on a cam, itself driven in rotation by the going train of the movement, the operation of the movement suffers a disturbance which may present non-negligible deviation values.

BRIEF SUMMARY OF THE INVENTION

The primary aim of the present invention is to overcome the drawbacks of the known mechanisms of the prior art, by proposing a movement for a timepiece with retrograde display in which the means for implementing the retrograde display almost do not disturb the operation of the movement at all.

To this end, the present invention more particularly concerns a movement for a timepiece of the type mentioned above, characterized by the fact that a force-regulating device is inserted between the elastic means and the lever.

Thanks to this characteristic, the operation of the movement has better precision. Moreover, this precision is maintained even in the case where the movement is adapted to the driving of a display member on a significant angular sector, in particular greater than 60 degrees, preferably greater than 120 degrees.

In one preferred embodiment, it is provided that the wheel is driven by a wheel frictionally mounted on a cylinder wheel tube, the lever comprising a rack having a toothing arranged engaged with a toothing of a pinion mounted free in rotation on the cylinder wheel tube and integral in rotation with an additional tube, the latter being designed to ensure the driving, at least indirectly, of a display member displaying hour information.

According to a first embodiment, one can provide that the force-regulating device comprises a second cam arranged integral with the lever and sharing an axis of rotation with this lever. In this case, the elastic means preferably comprise a long spring having a straight portion whereof one free end is arranged bearing against the periphery of the second cam. Thus, the application of the force on the lever is done in the form of a rotational torque applied directly to its axis of rotation due to the force undergone by the second cam.

According to a second embodiment, one can provide that the additional tube, designed to support the display member, is integral with an additional cam, having the same axis of rotation, and having a periphery of variable radius designed to cooperate with an additional feeler-spindle supported by an additional lever, the latter having a support surface arranged to cooperate with the elastic means.

In this case, the lever undergoes the force generated by the elastic means through its rack, the pinion and the additional cam, the periphery of which makes it possible to regulate the force effectively transmitted to the lever.

One may preferably provide that the periphery of the additional cam has a shape at least partially corresponding to a logarithmic curve portion.

Moreover, a runner may be supported by the additional feeler-spindle to ensure contact between the additional lever and the periphery of the additional cam with the least amount of friction possible.

Advantageously, a movement of this type can be implemented in a timepiece comprising a display member having a time size sweeping an angular sector having an angle greater than 120 degrees, such as an hour display over a sector of 270 degrees.

BRIEF DESCRIPTION OF THE DRAWINGS

Other characteristics and advantages of the present invention will appear more clearly upon reading the detailed description of one preferred embodiment which follows, done in reference to the appended drawings provided as non-limiting examples and in which.

DETAILED DESCRIPTION OF THE INVENTION

Figure 1:
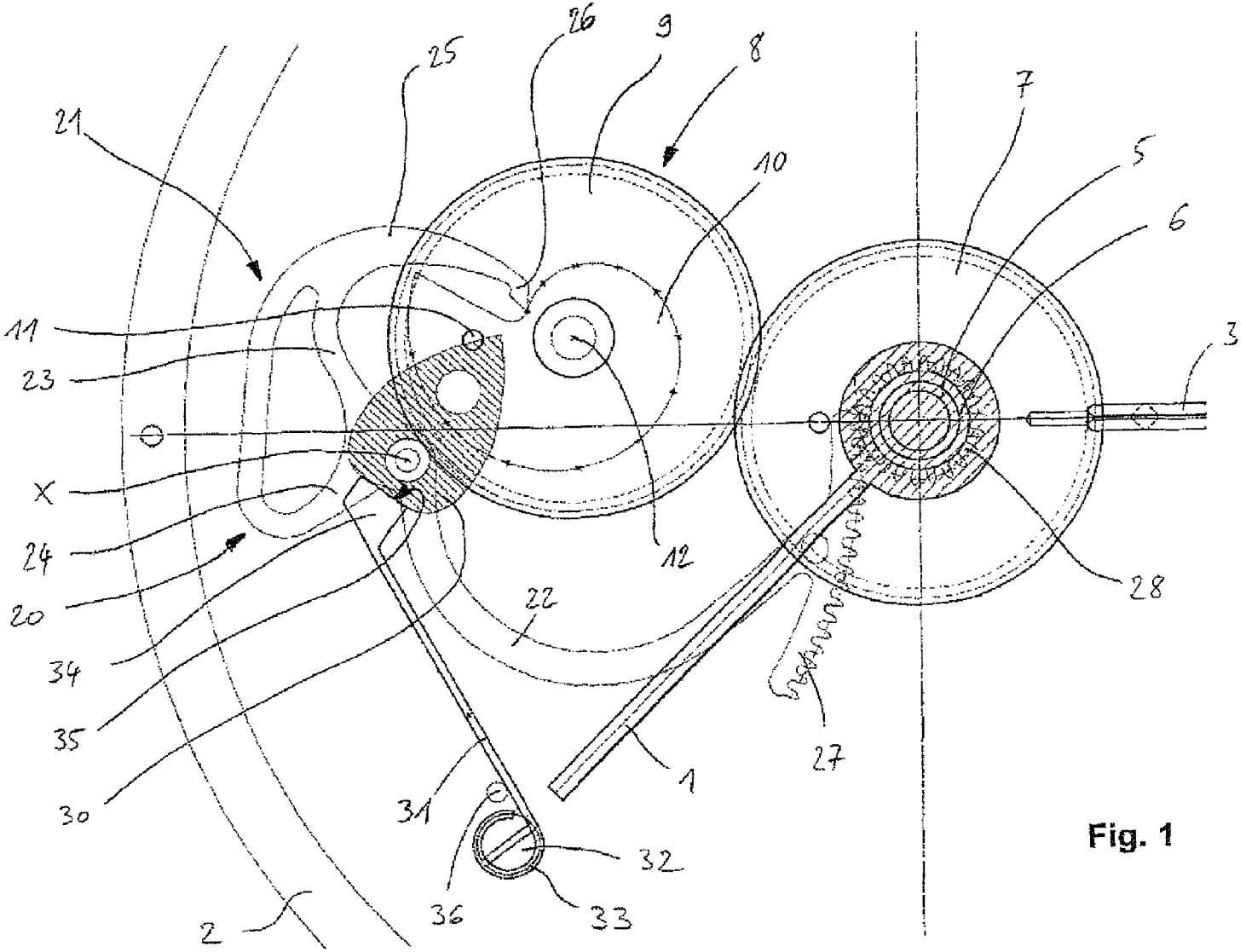
FIG. 1 illustrates a simplified top view of a detail of the timepiece movement according to a first variation of one preferred embodiment of the present invention, in a first configuration.

FIG. 1 shows a top view of a construction detail of the movement according to a first variation of one preferred embodiment of the present invention, more particularly of its mechanism for implementation of a retrograde display. This mechanism is presented in a first configuration in FIG. 1, and will be presented in a second, different configuration in FIG. 2.

The embodiment described, as a non-limiting illustration, concerns a drive mechanism of an hour hand 1 with a retrograde-type display, in particular relative to a graduated sector (not visible) extending over an angle of 270 degrees.

We have diagrammatically illustrated, in the figures, the implementation of the movement according to the invention in a timepiece comprising a case comprising in particular a middle 2. The movement comprises a plate (not shown) on which the display module rests, and in a hole of which a setting stem 3 is mounted, better visible in FIG. 3.

The hour hand 1 is arranged at the center of the timepiece while being driven by a cylinder wheel (reference 4, FIG. 3), the tube 5 of which supports an additional tube 6, mounted free in rotation on the cylinder wheel. The cylinder wheel is driven conventionally by a going train (not visible) of the movement, the latter possibly being of the mechanical or electromechanical type without effect on the object of the present invention.

An hour wheel 7 is also frictionally mounted on the cylinder wheel tube 5. A wheel unit 8 is arranged away from the hour wheel 7 and supports a control wheel 9 as well as a first cam 10, the periphery of which has a spiral shape. The control wheel 9 and the first cam 10 are made integral in rotation, using a pin 11, and share an axis of rotation 12 with the frame of the movement. The control wheel 9 has a peripheral toothing arranged engaged with the toothing of the hour wheel 7, such that the first cam 10 is driven in rotation, in the counterclockwise direction in FIG. 1, by the movement of the hour wheel 7.

The retrograde display mechanism also comprises a lever 20, mounted in rotation on the frame of the movement, along an axis X located in the immediate vicinity of the periphery of the control wheel 9. Going from its region pivotably mounted on the axis X, the lever 20 has two arms 21 and 22.

The first arm 21 initially comprises two portions 23 and 24 moving away from each other before coming together to form a loop in the extension of which extends a feeler-spindle 25. The free end 26 of the feeler-spindle, ending in a point, is arranged bearing against the periphery of the first cam 10.

The second arm 22 has an elongated and curved shape, to go around the first cam 10, ending with a rack 27, arranged engaged with a pinion 28 integral with the additional tube 6.

A second cam 30 is mounted in rotation on the axis X, while being integral with the lever 20. This has a heart-shaped periphery, more precisely defined by a double curve, each of which corresponds to a logarithmic curve portion.

A long spring 31 is fixed to the frame of the movement, using a screw 32, by a first end 33 wound in a ring shape, while its second end 34 has a flat surface 35 arranged bearing against the periphery of the second cam 30. A pin 36, integral with the frame, forms a counter-support to prevent the rotation of the spring in the counterclockwise direction.

One will note that it is important to ensure that friction between the flat surface 35 and the periphery of the second cam 30 is limited. Thus, one will be able, for example, to provide for using a material such as ruby or sapphire to produce an end attached on the long spring 31. In the alternative, one may provide the end 34 with a support supporting a runner (as visible in FIGS. 4 and 5) designed to ensure contact between the long spring 31 and the periphery of the cam 30.

From an operational perspective, when the first cam 10 turns in the counterclockwise direction, it has a increasing radius in comparison with the position of the feeler-spindle 25, driving a rotation of the lever 20 in the same direction. When the lever turns in relation to its axis X, the rack 27 causes a rotational movement of the additional tube 6, in the clockwise direction, this being free to turn in relation to the cylinder wheel. Thus, the hour hand 1 evolves in comparison with the graduations which may extend over twelve hours, for example, between the initial and final positions of the hand, these positions being spaced apart at an angle of 270 degrees according to the present embodiment, for information.

At the same time, the second cam 30 also turns in the counterclockwise direction, slightly deforming the spring 31 as its radius increases in the contact region of the flat surface 35.

The spring constant of the spring 31 is adjusted such that the contact of the point 26 of the feeler-spindle on the periphery of the first cam is guaranteed at all times, without, however, creating overly significant friction.

The feeler-sensor 25 thus has a progressive and continuous separation in reference to the axis of rotation 12 of the first cam 10. We have illustrated small x's on the periphery of the first cam to show the positions corresponding respectively to each of the hours displayed by the hour hand 1 in comparison with the graduations.

Figure 2:
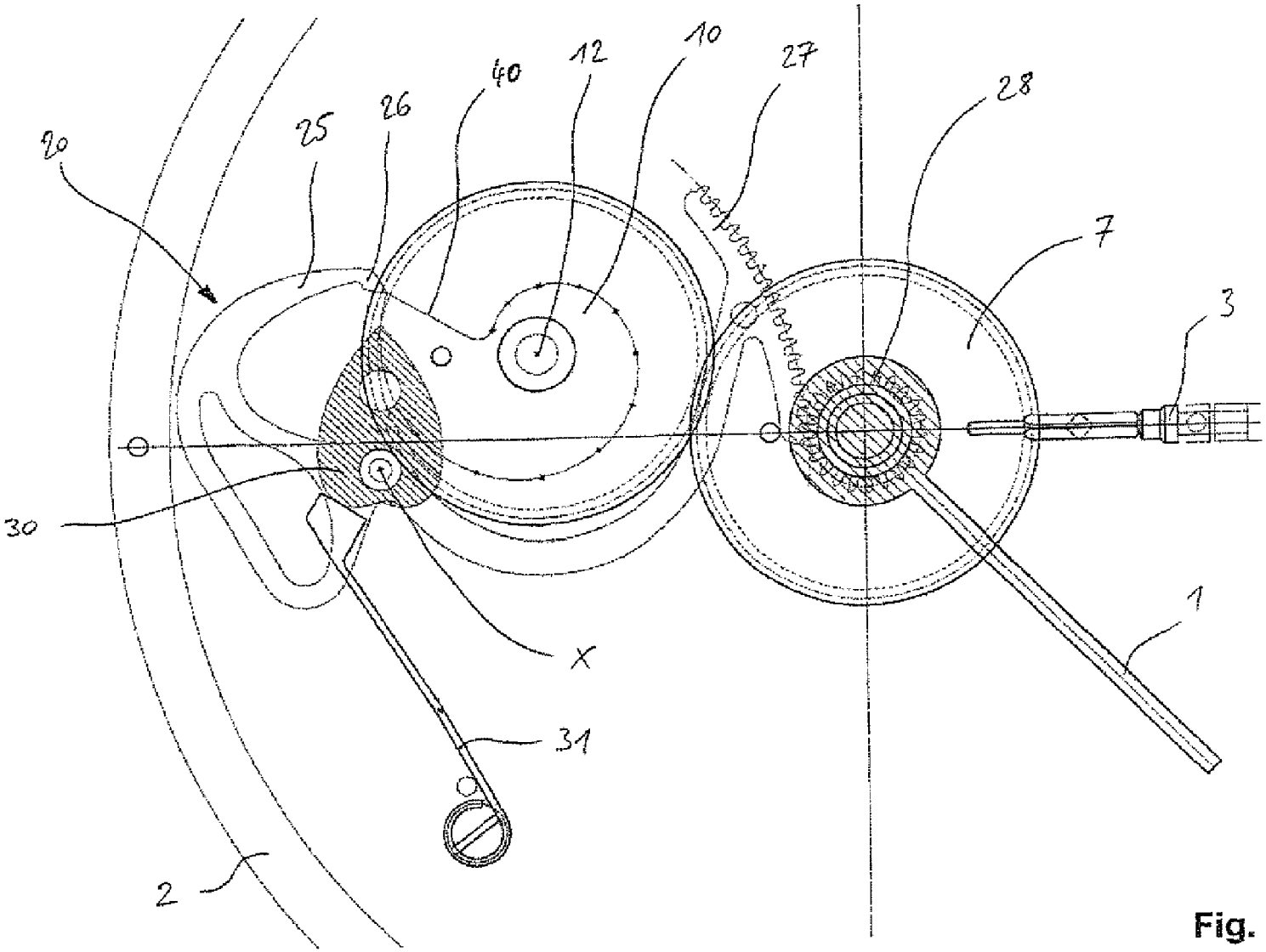
FIG. 2 illustrates a simplified top view similar to the view of FIG. 1, in a second configuration.

FIG. 2 shows a view similar to FIG. 1, in a different configuration of the retrograde display mechanism, more precisely, a little less than twelve hours after the configuration of FIG. 1, the first cam 10 having made almost a full revolution in this interval. According to the illustrated embodiment, the hour hand 1 has undergone an angular movement in the vicinity of 270 degrees in the same time.

It appears in this figure that, while the tip 26 of the feeler-spindle 25 has undergone a movement of maximal amplitude, the second cam 30 has completed a rotation along an angle smaller than 90 degrees. Its radius between the positions of FIG. 1 and FIG. 2 having varied little, the spring 31 has a limited tension, sufficient, however, to exert pressure on the second cam 30, aiming to return it to its position from FIG. 1, when the tip of the feeler-spindle passes the flank 40 of the periphery of the first cam 10. Thus, this operation is similar to the return to zero of the hands indicating a time measured in a timepiece movement with chronograph function.

Unlike the mechanisms of the prior art, the tension variation of the spring between these two extreme positions of the feeler-spindle advantageously has a negligible impact on the operation of the going train. This particular characteristic also makes it possible to use a time size indication sector of greater angular amplitude than with the earlier mechanisms.

Moreover, the action of the spring on the lever, via the second cam 30, makes it possible to obtain a slower return of the hour hand 1 to its initial position than in the timepieces according to the prior art, in which the spring acts directly on the lever. One can note that the theoretical return speed of the hand is constant throughout the duration of this movement due to the use of a logarithmic curve, which is not the case if the cam has a periphery whereof the shape is based on the Archimedes curve, in particular in the region of the locking position shown in FIG. 1, which is why the former is preferred.

Figure 3:
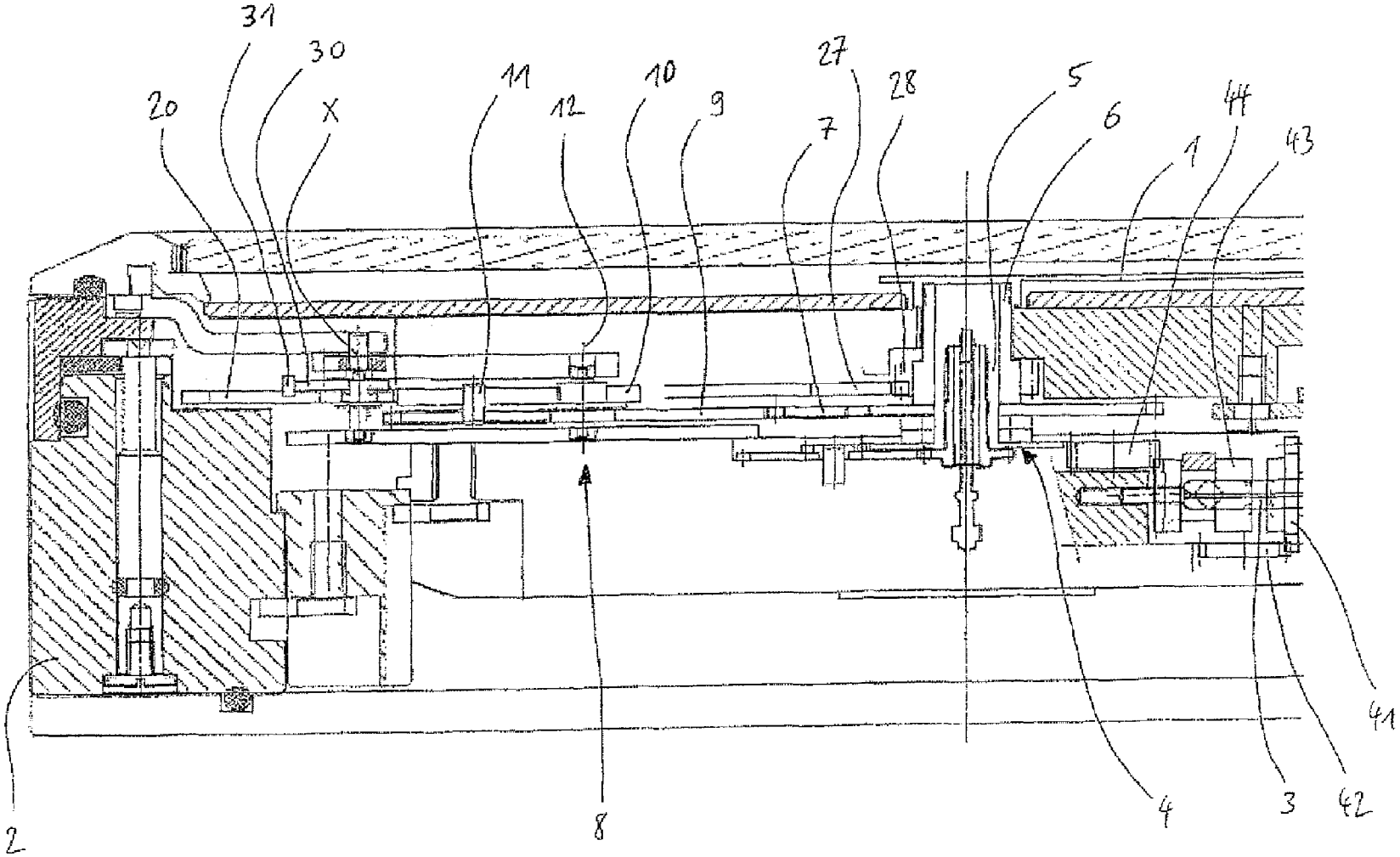
FIG. 3 illustrates a simplified transverse cross-sectional view of the movement from the preceding figures.

FIG. 3 shows a simplified transverse cross-sectional view of a part of the movement which has just been described in relation to FIGS. 1 and 2.

It appears from this figure that the shared axes of rotation 12 and X are defined by the use of unique pivots for the corresponding pieces, namely, on one hand, the control wheel 9 and the first cam 10, and on the other hand, the lever 20 and the second cam 30.

Moreover, it appears from FIG. 3 that the setting stem 3 supports, conventionally, a winding-pinion 41 arranged engaged with a crown-wheel 42 of the movement, to perform the winding of a barrel spring (not shown), as well as a sliding pinion 43 which can be brought to engage with an intermediate wheel 44, itself engaged with the cylinder wheel 4 to perform the setting of the display members.

During time setting operations, the hour wheel 7 is driven simultaneously with the cylinder wheel 4 to cause the control wheel 9 and the first cam 10 to turn and, as a result, the additional tube 6 supporting the hour hand 1.

One can note that from the position illustrated in FIG. 1, a counterclockwise rotation of the first cam 10 is not recommended due to the fact that the feeler-spindle 25 can be pushed against the flank 40 of the cam. In this case, the user must be able to feel a resistance and change the direction of rotation of the setting stem to perform the setting operation. If, despite everything, it were to insist on the wrong direction of rotation, the respective surfaces of the tip of the feeler-spindle and the flank of the cam are such that winding of the feeler-spindle along this is possible.

Figure 4:
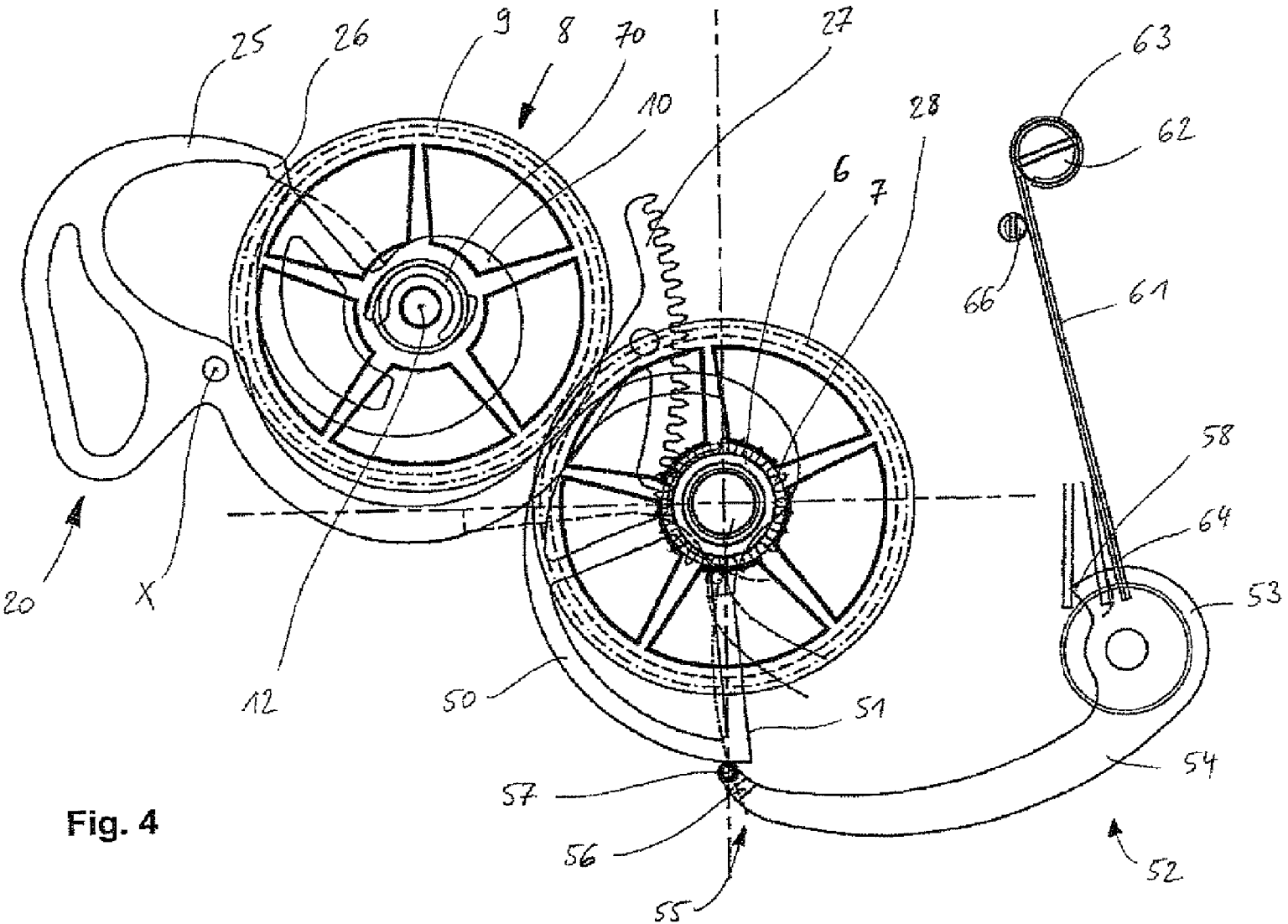
FIG. 4 illustrates a simplified top view of a detail of the timepiece movement according to a second variation of a preferred embodiment of the present invention.
Figure 5:
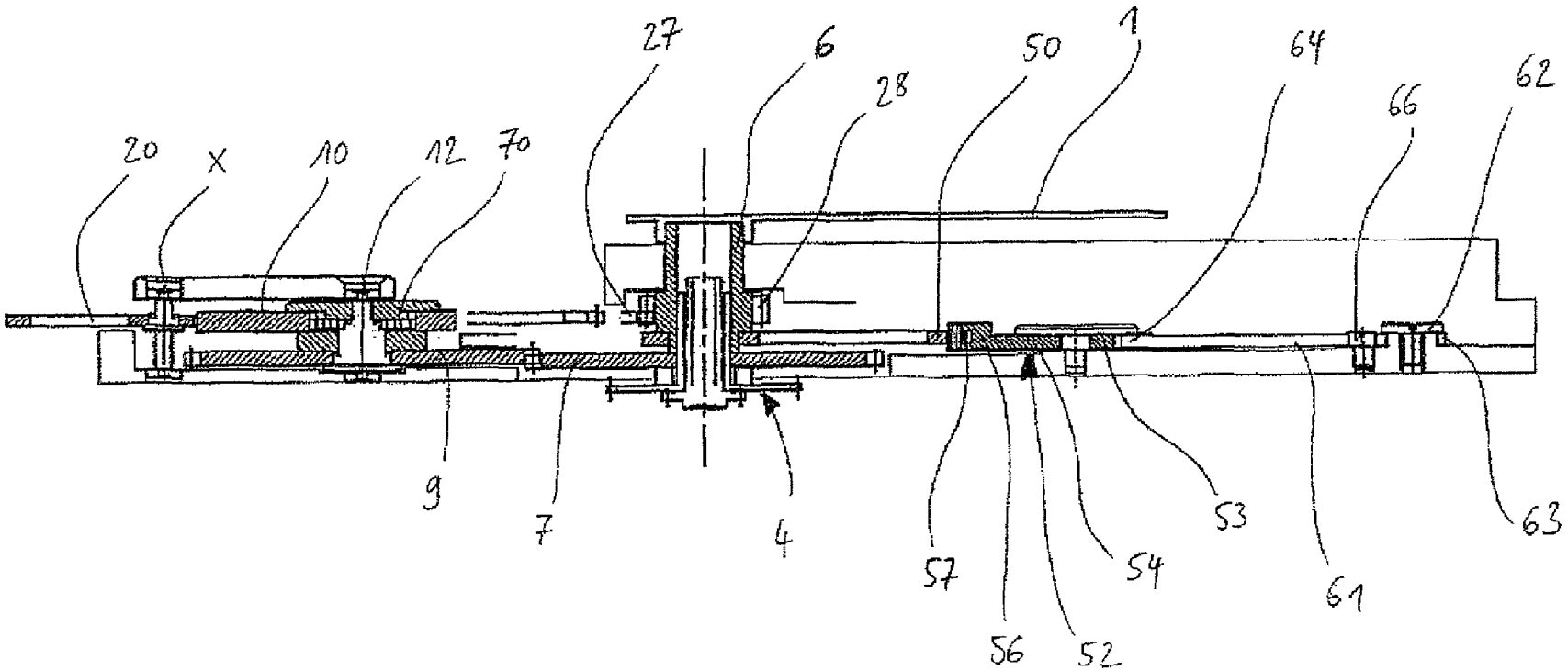
FIG. 5 illustrates a simplified transverse cross-sectional view of the movement of FIG. 4.

FIGS. 4 and 5 show, in simplified top and transverse cross-sectional views, respectively, a display module for clockwork movement according to a second variation of a preferred embodiment of the present invention.

The second variation is different from the first through a different arrangement of the elastic means making it possible to ensure a good quality of contact between the feeler-spindle 25 and the periphery of the first cam 10, the force-regulating means applied to the lever being adapted as a result.

More precisely, the additional tube 6 supporting the pinion 28 is also integral with an additional cam 50 having a periphery of variable radius. The latter has, from its smallest radius to its largest radius, a shape corresponding to a logarithmic curve portion. Moreover, the regions having the smallest radius and largest radius are connected by a substantially radial flank 51.

Moreover, the display module according to the second variation of embodiment also comprises an additional lever 52 mounted rotatingly on the frame of the movement, along an axis of rotation located away from the axis of rotation of the cylinder wheel 4.

The additional lever 52 comprises a base 53 from which extends an arm 54, the free end of which supports a feeler-spindle 55, here realized in the form of a support 56 supporting a runner 57 designed to be arranged bearing against the periphery of the additional cam 50. The implementation of a runner of this type makes it possible to reduce the friction resulting from the contact between the feeler-spindle 55 and the periphery of the additional cam 50, when the latter is driven in rotation under the effect of the cooperation between the rack 27 and the pinion 28. As already mentioned, the runner can be made in ruby or sapphire, as non-limiting information.

Moreover, the base 53 of the additional lever comprises a support surface 58 assuming the form of an edge.

A long spring 61 is fixed to the frame of the movement, using a screw 62, by a first end 63 wound into a ring shape, while its second end 64, free, is arranged bearing against the support surface 58 of the additional cam 50. A screw 66, integral with the frame, forms a counter-support to prevent the clockwise rotation of the spring, thereby making it possible to cause its deformation when the support surface 58 is driven in counterclockwise rotation, under the effect of the increase in the radius of the additional cam 50.

The screw 66 is preferably an eccentric thanks to which the orientation of the long spring 61 can be adjusted with great precision.

From an operational point of view, when the first cam 10 turns counterclockwise, it has an increasing radius in comparison with the position of the feeler-spindle 25, driving a rotation of the lever 20 in the same direction. When the lever turns in relation to its axis X, the rack 27 causes a rotational movement of the additional tube 6, clockwise, this being free to turn in relation to the cylinder wheel. Thus, the hour hand 1 evolves in comparison with graduations which may, for example, extend over twelve hours between the initial and final positions of the hand.

At the same time, the additional cam 50 turns simultaneously in the clockwise direction, thereby having a radius increasing to the feeler-spindle 55 of the additional lever 52 which turns, because of this, in the counterclockwise direction. The rotation of the additional lever causes a progressive deformation of the spring 61 as the radius of the periphery of the additional cam increases.

Thanks to this structure, the lever 20 undergoes at all times, except during the brief retrograde movement, two antagonistic forces, namely a first force tending to cause it to turn counterclockwise and exerted by the periphery of the first cam 10, and a second force tending to cause it to turn clockwise under the effect of the deformation of the spring 61, generating a force transmitted to the lever 20 through the additional lever 52, its feeler-spindle 55, the periphery of the additional cam 50, the pinion 28 and the rack 27.

The force generated by the deformation of the spring 61 is regulated by the shape of the periphery of the additional cam 50, which makes it possible to control the corresponding torque transmitted to the pinion 28. In reference to the first variation of embodiment, one will note that the regulation is done here with better precision insofar as the additional cam 50 has an angle of rotation much larger than that of the second cam 30 between the two extreme positions of the display member 1. Indeed, the present variation offers a reduction of the rotation of the lever 20 through the gear link between the rack 27 and the pinion 28 allowing the additional cam 50 to have a larger useful portion of its periphery than that of the second cam 30 of the first variation.

One can also see that this construction, due to the antagonistic forces it generates, presents the additional advantage of preventing the appearance of play at the level of the gear link provided between the pinion 28 and the rack 27.

The spring constant of the spring 61 is adjusted such that the contact of the tip 26 of the feeler-spindle on the periphery of the first cam 10 is guaranteed at all times, without, however, creating overly significant friction.

We have also diagrammed the presence of a coupling 70 to provide the connection between the control wheel 9 and the first cam 10, in complete safety, which makes it possible to offset the drawbacks previously mentioned in relation with time setting operations.

The preceding description corresponds to one preferred embodiment of the invention described non-limitingly. In particular, the shapes illustrated and described for the various component elements of the timepiece movement are not limiting. One may in particular use an Archimedean cam, for the second cam and for the additional cam, despite the drawbacks noted above, the principle of the invention remaining unchanged in this case. Likewise, the geometry illustrated and described for the lever is preferred because it presents a good comprise between its bulk and its equilibrium from an inertial perspective. The form of the lever in particular enables a near-alignment between the tip 26 of the sensor, the axis of rotation 12 of the first cam 10 and the region in which the rack 27 and the pinion 28 are engaged. Moreover, this geometry makes it possible to arrange the axis of rotation of the lever in the immediate vicinity of the cam while also having the possibility of applying the force of the spring near this same axis. Thus, it is possible to apply a significant return force on the lever, while also greatly limiting the amplitude of the deformations of the spring. However, one skilled in the art may choose a different lever geometry depending on his own needs.

As an example, one skilled in the art will not encounter any particular difficulties in adapting this teaching to his own needs, in particular to display time sizes other than the hour, without going outside the scope of the present invention.

The invention claimed is:

1. A display module for timepiece movement designed to drive a retrograde display member displaying at least one time division, comprising a frame supporting means for driving said retrograde display member comprising a wheel unit designed to be driven from a going train of the clockwork movement and supporting a first cam, sharing an axis of rotation with said wheel unit in reference to said frame, a lever supporting a feeler-spindle arranged so as to bear against the periphery of said first cam under the effect of deformable elastic means undergoing a deformation of variable amplitude, causing the application of a corresponding force on said lever, depending on the distance separating said feeler-spindle from said axis of rotation of the first cam, transmission means designed to connect said lever to said drive means, wherein a regulating device of said force is inserted between said elastic means and said lever.

2. The display module of claim 1, wherein said wheel unit is driven by a wheel integral with a cylinder wheel tube, said lever comprising a rack having a toothing arranged engaged with a toothing of a pinion mounted free in rotation on said cylinder wheel tube and integral in rotation with an additional tube designed to ensure the driving of a display member for hour information.

3. The display module of claim 2, wherein said feeler-spindle, said axis of rotation of said first cam and the region in which said rack and said pinion are engaged are substantially aligned.

4. The display module of claim 1, wherein said support of said feeler-spindle on said first cam generates a frictional force decreasing when said distance between said feeler-spindle and said axis of rotation of said first cam increases.

5. The display module of claim 1, wherein said regulating device comprises a second cam connected to said lever and having a periphery on which said force is applied.

6. The display module of claim 5, wherein said second cam and said lever share a same axis of rotation (X) in reference to said frame and are integral in rotation.

7. The display module of claim 6, wherein said second cam has a heart-shaped periphery.

8. The display module of claim 5, wherein at least one portion of said periphery designed to come into contact with said feeler-spindle corresponds to a logarithmic curve portion.

9. The display module of claim 5, wherein said elastic means comprise a long spring having a straight portion whereof one free end is arranged bearing against the periphery of said second cam.

10. The display module of claim 2, wherein said additional tube, designed to support said display member, is integral with an additional cam, sharing the same axis of rotation, and having a periphery of variable radius designed to cooperate with an additional feeler-spindle supported by an additional lever having a support surface arranged to cooperate with said elastic means.

11. The display module of claim 10, wherein the periphery of said additional cam has a shape at least partially corresponding to a logarithmic curve portion.

12. The display module of claim 10, wherein said additional feeler-spindle supports a runner arranged to provide the contact between said additional lever and the periphery of said additional cam.

13. The display module of claim 2, wherein said support of said feeler-spindle on said first cam generates a frictional force decreasing when said distance between said feeler-spindle and said axis of rotation of said first cam increases.

14. The display module of claim 2, wherein said regulating device comprises a second cam connected to said lever and having a periphery on which said force is applied.

15. The display module of claim 3, wherein said support of said feeler-spindle on said first cam generates a frictional force decreasing when said distance between said feeler-spindle and said axis of rotation of said first cam increases.

16. The display module of claim 3, wherein said regulating device comprises a second cam connected to said lever and having a periphery on which said force is applied.

17. The display module of claim 3, wherein said additional tube, designed to support said display member, is integral with an additional cam, sharing the same axis of rotation, and having a periphery of variable radius designed to cooperate with an additional feeler-spindle supported by an additional lever having a support surface arranged to cooperate with said elastic means.

18. A timepiece movement designed to drive a retrograde display member displaying at least one time division, comprising a frame supporting a going train, means for driving said retrograde display member comprising a wheel unit arranged so as to be driven from said going train and supporting a first cam, sharing the same axis of rotation as said wheel unit in reference to said frame, a lever supporting a feeler-spindle arranged so as to bear against the periphery of said first cam under the effect of deformable elastic means undergoing a deformation of variable amplitude, driving the application of a corresponding force on said lever, depending on the distance separating said feeler-spindle from said axis of rotation of said first cam, transmission means designed to connect said lever to said drive means, wherein a regulating device of said force is inserted between said elastic means and said lever.

19. A timepiece comprising a case closed by a glass wherein is housed the movement of claim 18, arranged so as to drive a display member having at least one time size visible through said glass, wherein said time size is displayed on an angular sector having an angle greater than 60 degrees.

* * * * *